US007837312B2

(12) United States Patent
Wanibe

(10) Patent No.: US 7,837,312 B2
(45) Date of Patent: Nov. 23, 2010

(54) LIQUID CARTRIDGE AND METHOD FOR MANUFACTURING THE SAME

(75) Inventor: Akihisa Wanibe, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 886 days.

(21) Appl. No.: 11/738,239

(22) Filed: Apr. 20, 2007

(65) Prior Publication Data

US 2007/0247498 A1 Oct. 25, 2007

(30) Foreign Application Priority Data

Apr. 20, 2006 (JP) ..... 2006-117282

(51) Int. Cl.
*B41J 2/175* (2006.01)

(52) U.S. Cl. ..... 347/86; 347/1; 347/2; 347/3; 347/4; 347/5; 347/6; 347/7; 347/84; 347/85; 347/87

(58) Field of Classification Search ..... 347/1–109
See application file for complete search history.

(56) References Cited

U.S. PATENT DOCUMENTS

| | | | | |
|---|---|---|---|---|
| 5,831,656 | A * | 11/1998 | Chosa | 347/108 |
| 6,290,343 | B1 * | 9/2001 | Lewis et al. | 347/85 |
| 6,634,738 | B1 * | 10/2003 | Shinada et al. | 347/86 |
| 6,908,184 | B2 * | 6/2005 | Shinada et al. | 347/86 |
| 7,384,135 | B2 * | 6/2008 | Silverbrook et al. | 347/86 |

FOREIGN PATENT DOCUMENTS

| | | | |
|---|---|---|---|
| JP | 08-145018 | A | 6/1996 |
| JP | 2001-217572 | A | 2/2001 |
| JP | 2001-160695 | A | 6/2001 |
| JP | 2001-180003 | A | 7/2001 |
| JP | 2001-196769 | A | 7/2001 |
| JP | 2004-090624 | A | 3/2004 |

* cited by examiner

*Primary Examiner*—Charlie Peng
*Assistant Examiner*—Guy G Anderson
(74) *Attorney, Agent, or Firm*—Sughrue Mion, PLLC

(57) ABSTRACT

A liquid cartridge has a container main body detachably mounted to a cartridge mounting section of a liquid consuming apparatus. The container main body includes a case main body having a liquid reservoir and a cover that covers one side of the case main body; a board mounting section provided on an outer side of the container main body, for mounting a circuit board having an information storage element, the board mounting section having a pair of board fixing bosses to be fitted in the mounting holes of the circuit board to locate the circuit board, and four guide walls provided on the peripheral four sides of the circuit board located by the pair of board fixing bosses. The three guide walls of the four guide walls that constitute the board mounting section form a substantially U-shaped opening that is open to the cover on the outer side of the case main body, and the other guide wall is at a rim of the cover. The center wall of the three guide walls facing the guide wall on the cover side has a pair of notches at both ends. The pair of board fixing bosses is disposed at the positions on the outer surface of the case main body facing the pair of notches.

4 Claims, 9 Drawing Sheets

LIQUID CARTRIDGE AND METHOD FOR MANUFACTURING THE SAME

CROSS-REFERENCE TO RELATED PATENT APPLICATIONS

This application claims priority from Japanese Patent Application 2006-117282, which is incorporated by reference herein, in its entirety.

BACKGROUND OF THE INVENTION

1. Field of the Invention

The present invention relates to a liquid cartridge including a board mounting section for mounting a circuit board on an outer side of the main body of a liquid container and a method for manufacturing the same.

2. Description of the Related Art

Inkjet printers are discussed below as an example of a more general class of devices that may be described as liquid consuming apparatuses, and the comments made below with respect to inkjet printers should be understood to apply as well, in the main, to liquid consuming apparatuses. Inkjet printers generally record images or characters by feeding a recording head with ink held in an ink cartridge (a liquid cartridge) mounted to a cartridge mounting section in the apparatus and by applying a jet of ink droplets onto a recording object, such as paper, with the recording head.

The recording heads of inkjet printers control a jet of ink droplets, most commonly using heat or vibration. Accordingly, if the ink cartridge runs out of ink to carry out an ink ejecting operation with no ink supplied, the recording heads will malfunction, possibly being damaged or rendered unusable by a typical user.

Accordingly, for inkjet printers, it is necessary to monitor the ink level of the ink cartridge so as to prevent the recording head from attempting to perform an ink ejecting operation with no ink.

Furthermore, different use conditions such as full-color picture printing and single-color text printing lead to differences in the color and amount of ink consumed.

Therefore, some recent inkjet printers adopt ink cartridges, part of which can be changed so as to meet the use conditions. Such inkjet printers need to manage use history or the like, such as whether the ink cartridges mounted to the cartridge mounting section are new ones or reused ones.

The reader's attention is now drawn to ink cartridges 1 and 2 shown in FIGS. 8A and 8B and FIGS. 9A and 9B. Such cartridges have been proposed to help cope with the situation described above. The ink cartridges 1 and 2 have a container main body 4 composed of a case main body 5 including an ink reservoir 5*a* and a supply port 5*b* for supplying the ink in the ink reservoir 5*a* to an external device (the recording head of the inkjet printer) and a cover 6 covering one side of the case main body 5.

The container main body 4 has, on an outer side, a recess (also referred to a board mounting section) 11 for mounting a circuit board 9 (see FIG. 9B) having an information storage element (such as an IC chip) 8 on the back.

The surface of the circuit board 9 (opposite to the surface having the information storage element 8) has a connecting terminal that electrically connects the information storage element 8 to a connecting terminal mounted to the cartridge mounting section by connecting to the connecting terminal when the ink cartridges 1 and 2 are mounted to the cartridge mounting section of the inkjet printer.

The recess 11 has a pair of board fixing bosses 12*a* and 12*b* that fit in the mounting holes of the circuit board 9 to locate the circuit board 9, and four walls 13*a* to 13*d* erected along the peripheral four sides of the circuit board 9 located by the pair of board fixing bosses 12*a* and 12*b*. The circuit board 9 located by the board fixing bosses 12*a* and 12*b* is fixed in the recess 11 by swaging the ends of the board fixing bosses 12*a* and 12*b* with heat.

The four walls 13*a* to 13*d* are for preventing the connecting terminal (or the like) on the surface of the circuit board 9 from coming into contact with an external structure or the like, which undesired contact might result in staining when the cartridge is attached or detached. The heights of the walls 13*a* to 13*d* are set so that the connecting terminal on the surface of the circuit board 9 does not protrude from the ends of the walls 13*a* to 13*d*.

The ink cartridges 1 and 2 have the same structure in which the case main body 5 and the cover 6 are resin injection-moldings and the recess 11 is disposed on an outer side of the case main body 5.

However, in the case of the ink cartridge 1 shown in FIGS. 8A and 8B, the recess 11 is integrally formed in the case main body 5 using a sliding die 15 separate from upper and lower dies (a pair of dies), as shown in FIG. 8B (for example, refer to JP-A-2001-180003).

In contrast, in the case of the ink cartridge 2 shown in FIGS. 9A and 9B, the recess 11 is defined by a frame 17 that is injection molded separately from the case main body 5, and the frame 17 is integrated with the case main body 5 with recess positioning bosses 18*a* and 18*b* protruding from an outer side of the case main body 5 (for example, refer to JP-A-2004-90624).

When the ink cartridges 1 and 2 are mounted to the cartridge mounting section of an inkjet printer, information can be exchanged between the control means of the printer and the information storage element 8 of the circuit board 9, thus facilitating managing the amount of remaining ink by the printer.

However, in the case of the ink cartridge 1 shown in FIGS. 8A and 8B, the sliding die 15 that slides in the direction perpendicular to the removing direction of the upper and lower dies must be combined with a forming die for use in manufacturing the case main body 5, thus causing complication of the forming die to increase the cost.

In contrast, in the case of the ink cartridge 2 in which the recess 11 is formed by the frame 17 separate from the case main body 5, although the forming die for the case main body 5 has a simple structure with no sliding die, another forming die for the frame 17 is needed and the process of combining the frame 17 with the case main body 5 is added, and thus the increase in the number of dies and the increase of the combining process causes an increase in cost and a decrease in productivity.

SUMMARY OF THE INVENTION

An advantage of some aspects of the invention is to decrease the manufacturing cost and increase the productivity by simplifying the forming die and decreasing the number of assembly steps in manufacturing a liquid cartridge that has a circuit-board mounting section on an outer side of the container main body.

According to a first aspect of the invention, there is provided a liquid cartridge including: a container main body detachably mounted to a cartridge mounting section of a liquid consuming apparatus, the container main body including a case main body having a liquid reservoir and a cover that covers one side of the case main body; a board mounting section provided on an outer side of the container main body, for mounting a circuit board having an information storage element, the board mounting section having a pair of board fixing bosses to be fitted in the mounting holes of the circuit board to locate the circuit board, and four guide walls provided on the peripheral four sides of the circuit board located by the pair of board fixing bosses. The three guide walls of the four guide walls constituting the board mounting section form a substantially U-shape opening that is open to the cover on the outer side of the case main body, and the other guide wall is provided at a rim of the cover. The center wall of the three guide walls facing the guide wall on the cover side has a pair of notches at both ends. The pair of board fixing bosses is disposed at the positions on the outer surface of the case main body facing the pair of notches.

According to a second aspect of the invention, there is provided a method for manufacturing the liquid cartridge according to the first aspect of the invention. The method includes: forming the case main body and the cover with a pair of first and second forming dies that is drawn in the direction of the combination of the case main body and the cover. The pair of board fixing bosses includes a first boss-forming section and a second boss-forming section, the first boss-forming section being provided at the first forming die for forming the case main body and forming the pair of notches and the outer surfaces of the pair of board fixing bosses adjacent to the notches, and the second boss-forming section being disposed at the second forming die and forming the inner surface of the center wall and the outer surfaces of the pair of board fixing bosses adjacent to the substantially U-shaped opening.

According to the liquid cartridge with the above structure and the method for manufacturing it, the board mounting section for mounting the circuit board to an outer side of the container main body is partly integrated with the case main body, and the remaining part is integrated with the cover. This eliminates the need for preparing a forming die exclusive to the board mounting section in addition to one for forming the container main body, and also the need for combining the board mounting section with the container main body.

In other words, the four guide walls that constitute the board mounting section have a structure in which the three guide walls form a substantially U-shaped opening that is open to the cover on the outer side of the case main body, and the remaining guide wall is disposed at a rim of the cover. This prevents the guide walls that constitute the recessed board mounting section from obstructing the removal of the forming dies when molding the case main body.

The board mounting section can be formed with only a pair of forming dies, and without using a sliding die that may cause complication of the forming dies. Moreover, the first boss-forming section that forms the outer surface of the board fixing bosses of the board mounting section adjacent to the notches can be drawn from the notches in the direction in which the dies are drawn. This allows integral molding of the board fixing bosses without using a sliding die that may cause complication of the forming dies.

In the liquid cartridge with the above structure, it is preferable that the board mounting section have a relief recess for preventing interference with the information storage element mounted to the circuit board.

In the method for manufacturing the liquid cartridge, it is preferable that the relief recess for preventing interference with the information storage element mounted on the circuit board be formed by a recess forming section of the second forming die.

According to the liquid cartridge with the above structure and the method for manufacturing it, the container main body having the relief recess for preventing interference with the information storage element mounted on the circuit board can also be formed with only the pair of forming dies. This simplifies the structure of the forming dies and the number of assembly steps, thereby reducing the cost of manufacturing the liquid cartridge and increasing the productivity.

According to the liquid cartridge and the method for manufacturing it according to some aspects of the invention, in integrally forming the container main body having the board mounting section to which a circuit board is to be mounted, the case main body can be formed only with a pair of forming dies. This simplifies the structure of the forming dies and the number of assembly steps, thereby reducing the cost of manufacturing the liquid cartridge and increasing the productivity.

BRIEF DESCRIPTION OF THE DRAWINGS

The invention will be described with reference to the accompanying drawings, wherein like numbers reference like elements.

DETAILED DESCRIPTION OF EXEMPLARY EMBODIMENTS OF THE INVENTION

A liquid cartridge according to an embodiment of the invention and a method for manufacturing the same will be described in detail with reference to the accompanying drawings.

Figure 1:
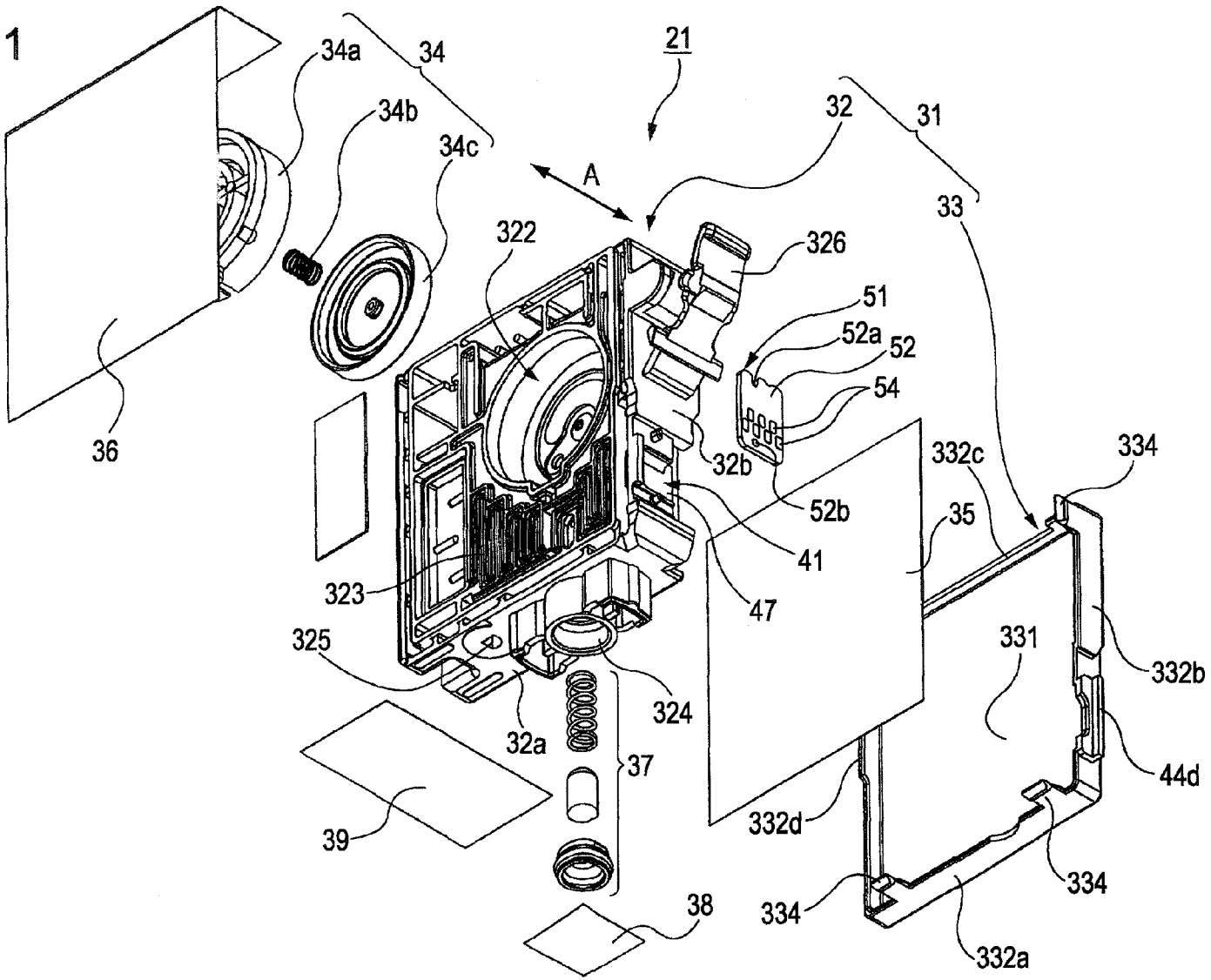
FIG. 1 is an exploded perspective views of a liquid cartridge according to an embodiment of the invention, as viewed obliquely from below.
Figure 2:
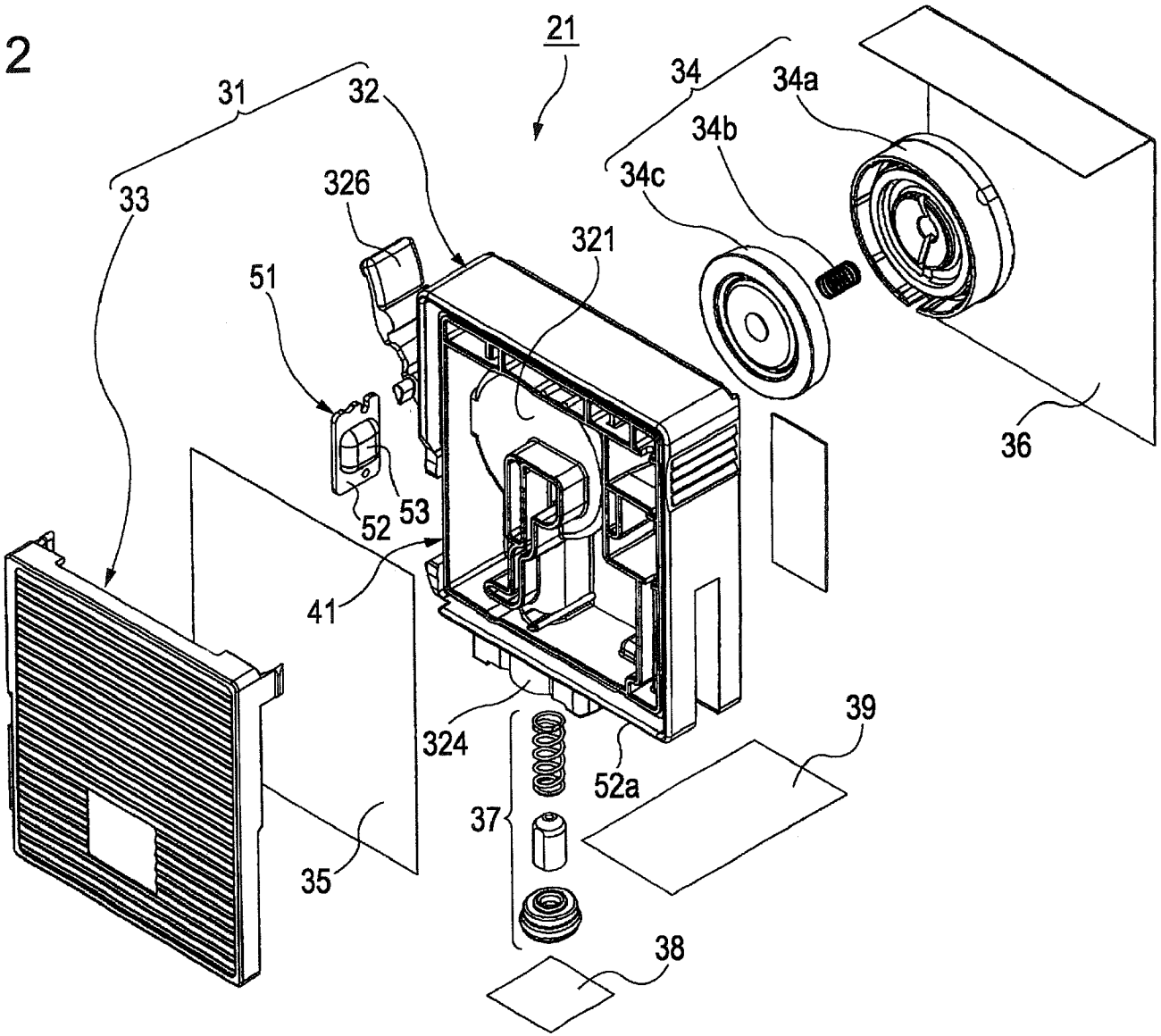
FIG. 2 is an exploded perspective views of the liquid cartridge according to the embodiment of the invention, as viewed obliquely from above.
Figure 3:
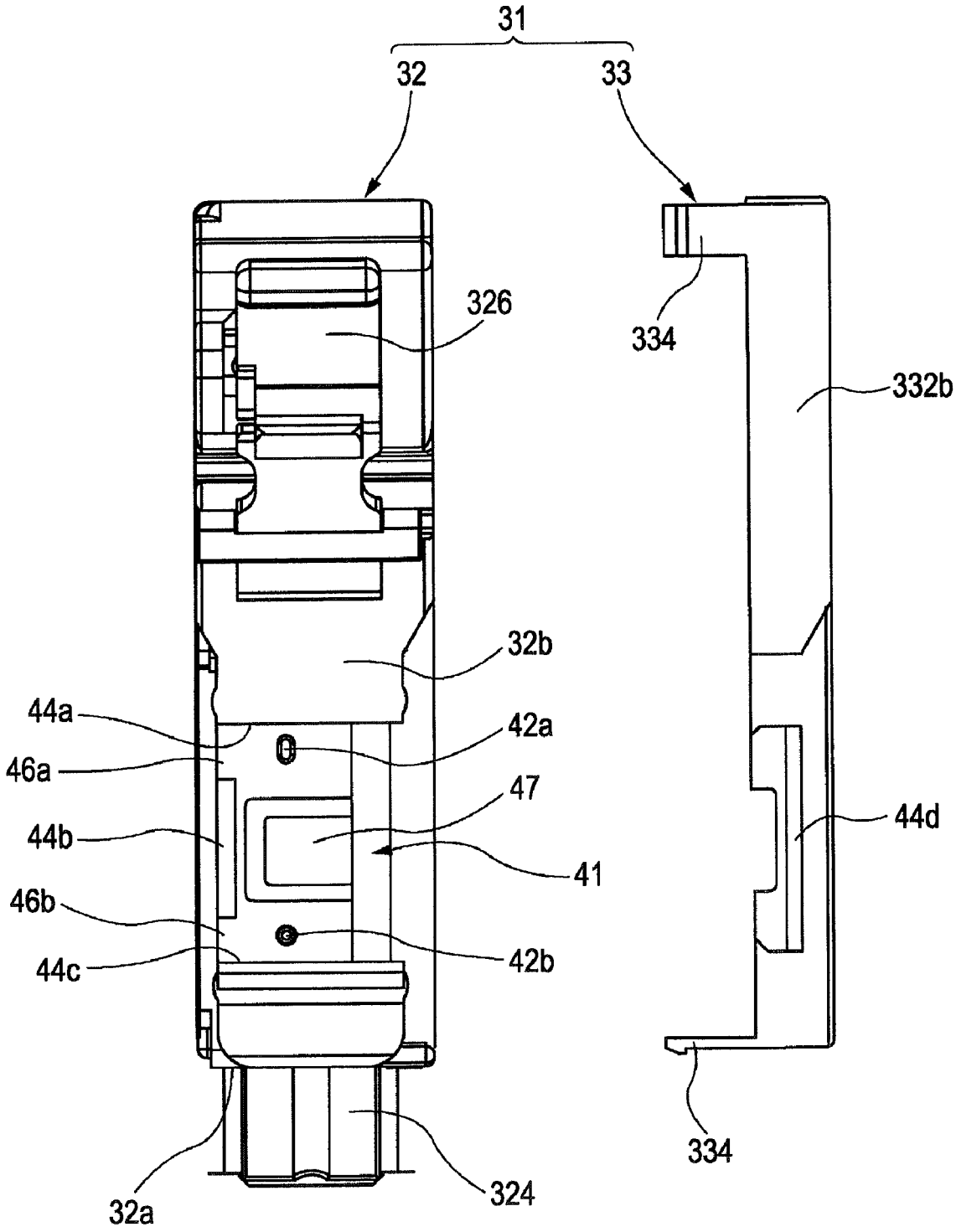
FIG. 3 is an exploded view of the side of a case main body and a cover that constitute the container main body shown in FIG. 1, to which a circuit board is to be mounted.
Figure 4:
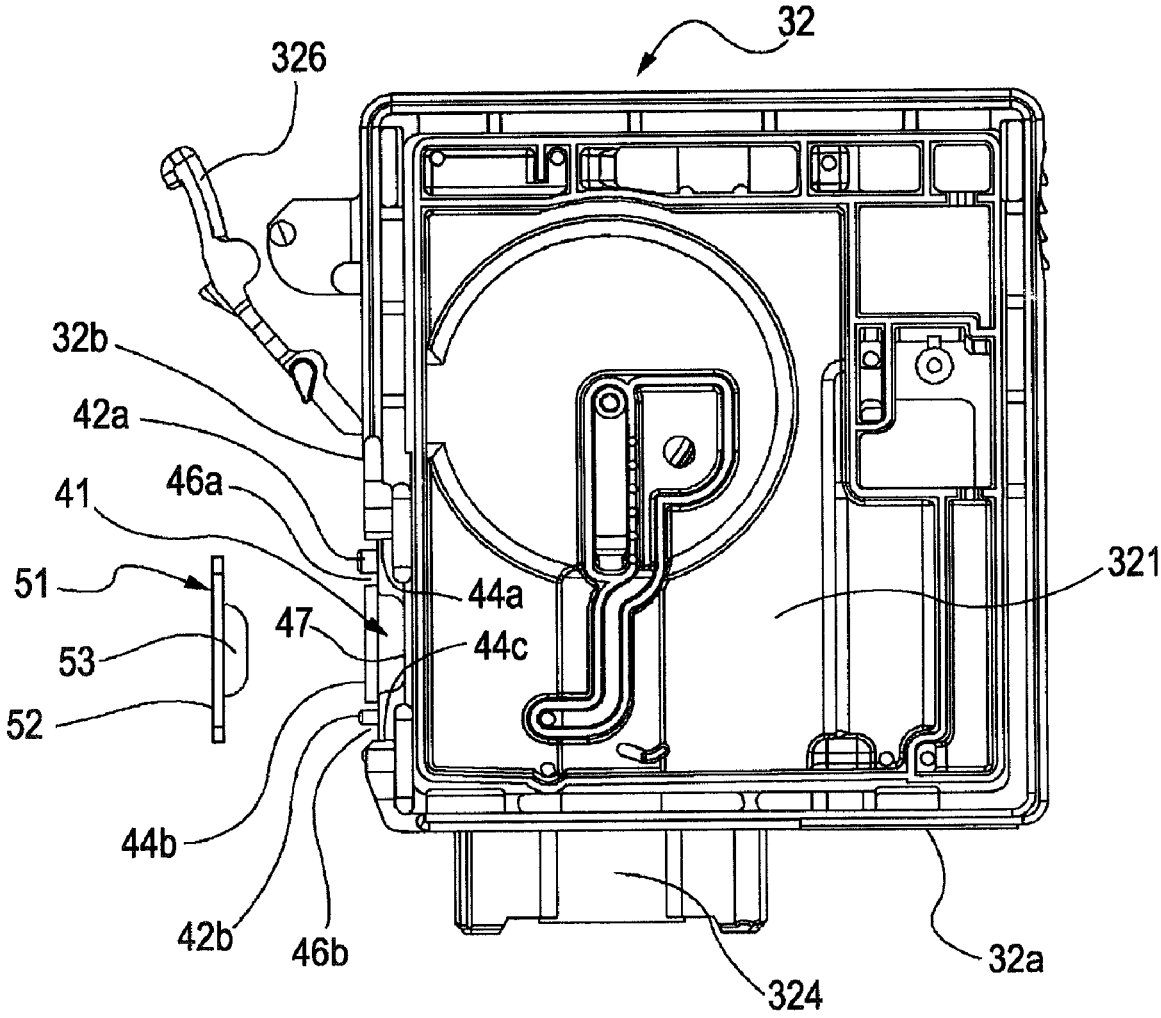
FIG. 4 is a front view of the case main body shown in FIG. 3.
Figure 5:
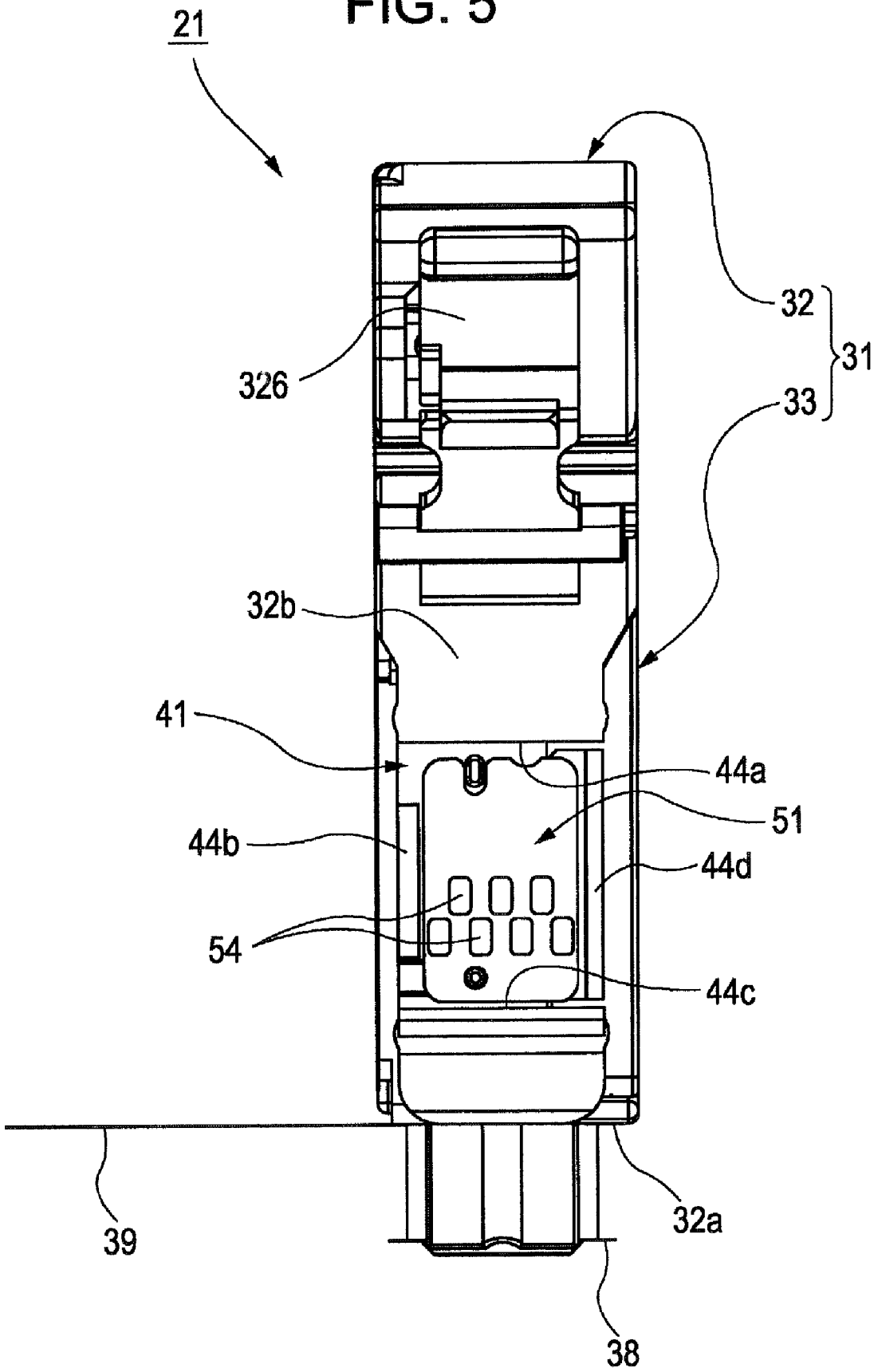
FIG. 5 is a side view of the container main body shown in FIG. 3 in an assembled state.
Figure 6A:
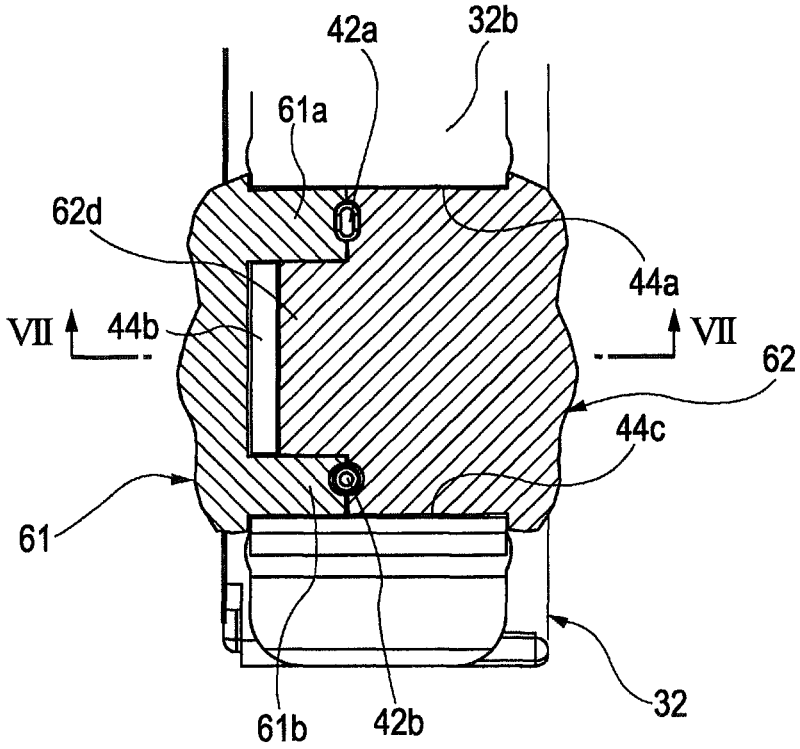
FIG. 6A is a diagram illustrating a method for manufacturing board fixing bosses on the board mounting section of the case main body shown in FIG. 3.
Figure 6B:
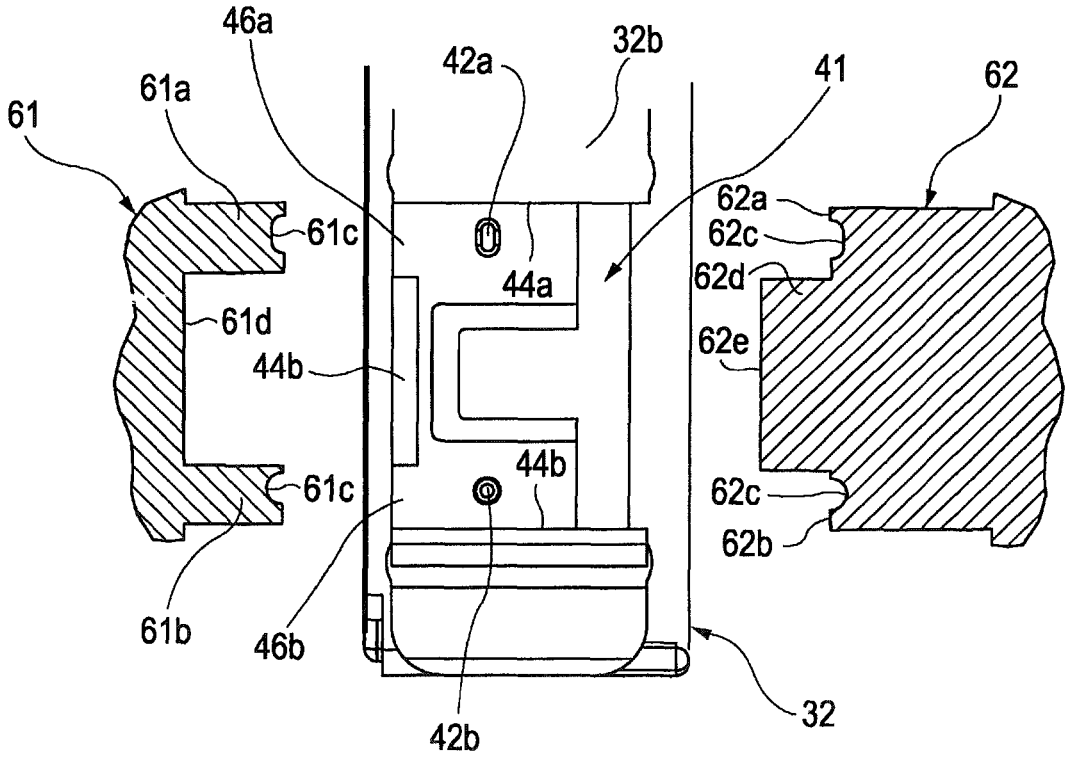
FIG. 6B is a diagram illustrating the method for manufacturing board fixing bosses on the board mounting section of the case main body shown in FIG. 3.
Figure 7:
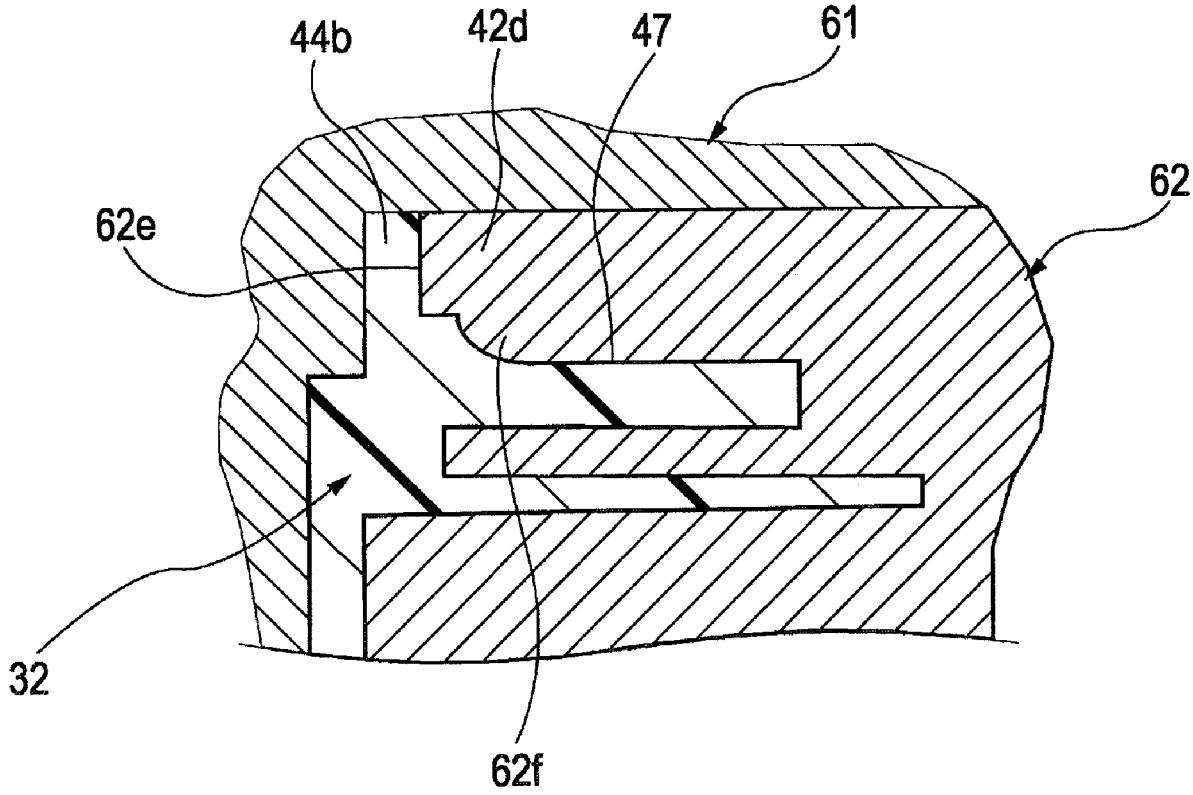
FIG. 7 is a cross-sectional view taken along line VII-VII of FIG. 6A.
Figure 8A:
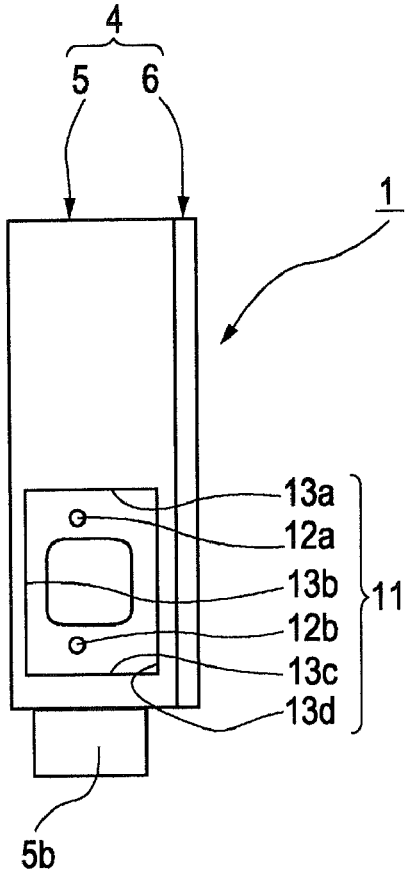
FIG. 8A is a side view of a related-art ink cartridge, showing the side of the container main body to which a circuit board is to be mounted.
Figure 8B:
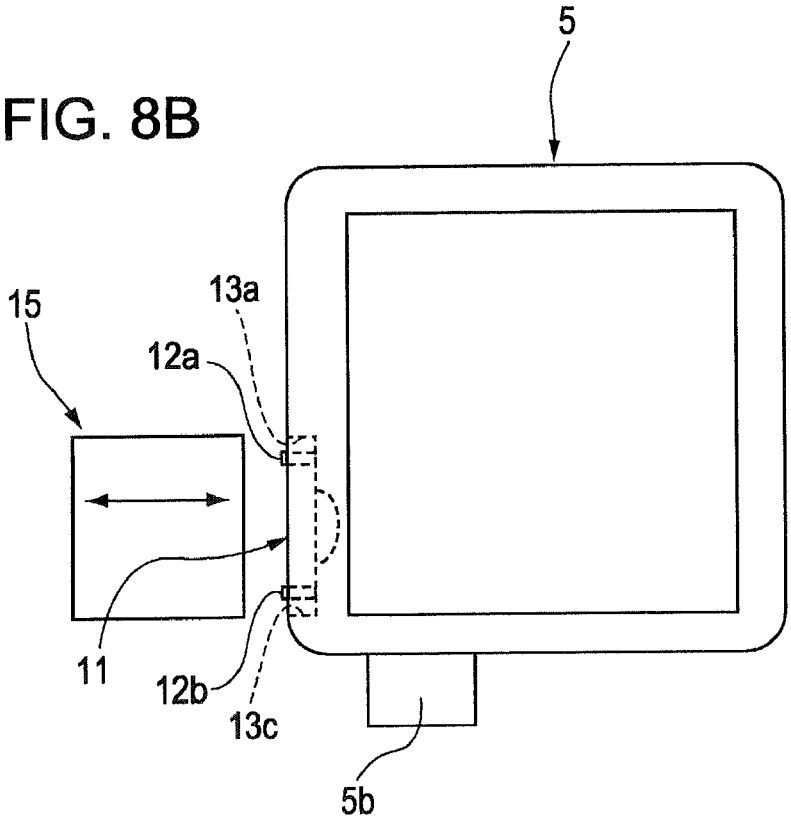
FIG. 8B is a front view of the case main body shown in FIG. 8A.
Figure 9A:
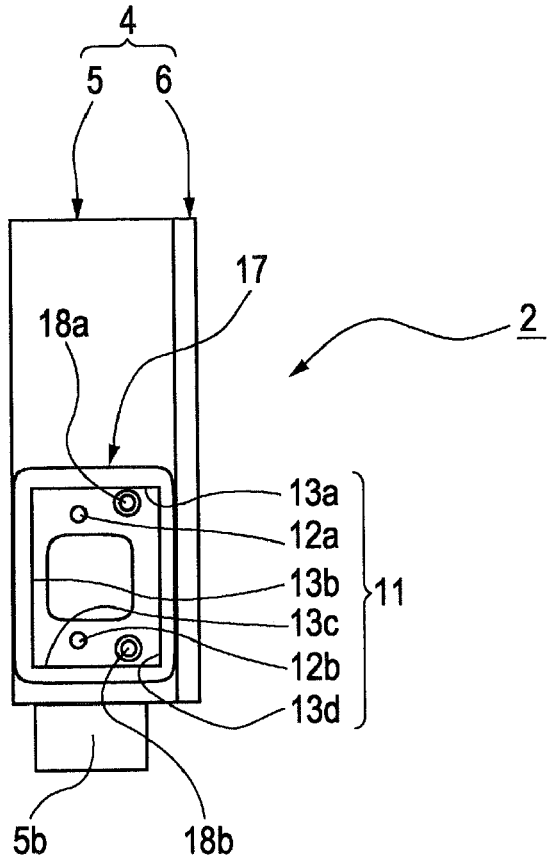
FIG. 9A is a side view of another related-art ink cartridge, showing the side of the container main body to which a circuit board is to be mounted.
Figure 9B:
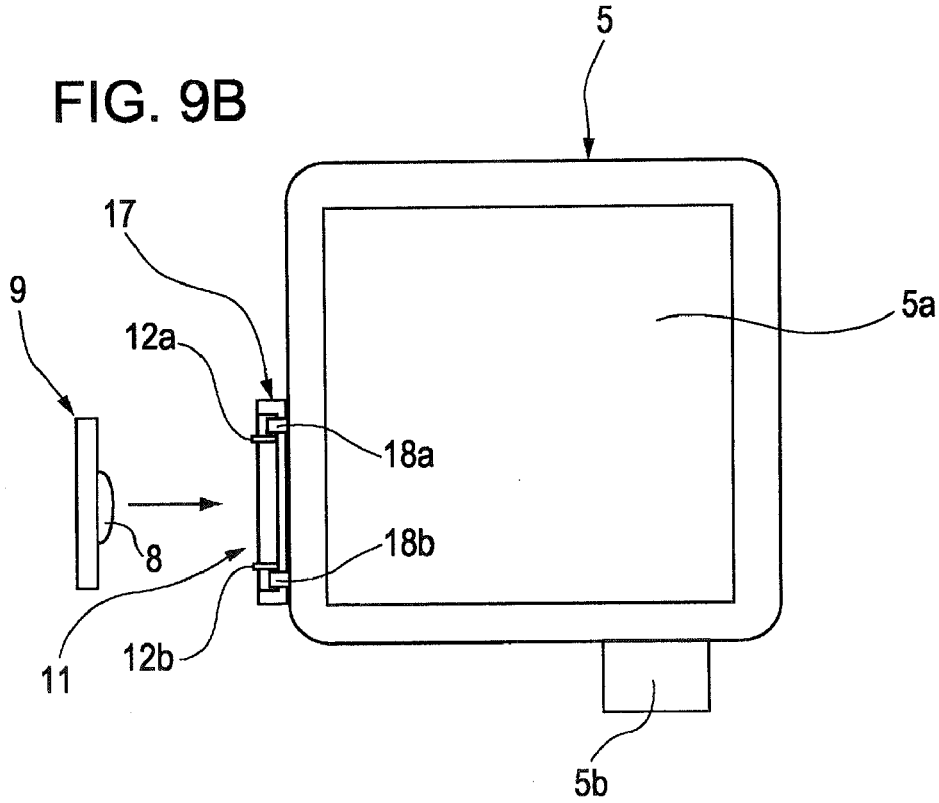
FIG. 9B is a front view of the case main body shown in FIG. 9A.

FIGS. 1 and 2 are exploded perspective views of a liquid cartridge, denoted by numeral 21, according to an embodiment of the invention; FIG. 3 is an exploded view of the side of a case main body 32 and a cover 33 that constitute the container main body 31 shown in FIG. 1, to which a circuit board 9 is to be mounted; FIG. 4 is a front view of the case main body 32 shown in FIG. 3; FIG. 5 is a side view of the container main body 31 shown in FIG. 3 in an assembled state; FIGS. 6A and 6B are diagrams illustrating a method for manufacturing board fixing bosses on the board mounting section 41 of the case main body 32 shown in FIG. 3; and FIG. 7 is a cross-sectional view taken along line VII-VII of FIG. 6A.

The ink cartridge (liquid cartridge) 21 according to the embodiment is detachably attached to the cartridge mounting section of an inkjet printer (a liquid consuming apparatus).

As shown in FIGS. 1 and 2, the container main body 31 of the ink cartridge 21 has a case main body 32 including an ink reservoir (a liquid reservoir) and a cover that covers one side of the case main body 32.

The case main body 32 is a resin-ejection molding. The direction opposite to the cover 33, indicated by arrow A in FIG. 1, is the direction in which the forming die is drawn (divided).

The case main body 32 has an ink reserving recess 321 (see FIGS. 2 and 4) serving as an ink reservoir on the side covered with the cover 33 and has a valve mounting recess 322 for mounting a pressure controller 34 and a meandering fine groove section 323 serving as an air passage on the side opposite to the side covered with the cover 33.

The surface of the case main body 32 covered with the cover 33 is joined with a resin film 35 and the opposite side is joined with a resin film 36 by heat welding, respectively.

The resin film 35 seals the open surface of the ink reserving recess 321 to form an ink reservoir that holds ink in cooperation with the ink reserving recess 321. The resin film 36 seals the open surface of the valve mounting recess 322 and the groove section 323 to form a valve chamber, the air passage, and an ink passage.

A bottom wall 32*a*, one of the outer surfaces perpendicular to the surface of the case main body 32 to which the resin film 35 is welded has a supply port 324 for supplying the ink held in the ink reservoir to an external apparatus (an inkjet printer).

The supply port 324 has a valve mechanism 37 and a sealing film 38 welded with heat. The valve mechanism 37 opens the ink passage when an ink supply needle or the like attached to the cartridge mounting section of the inkjet printer is inserted. The sealing film 38 is torn open when the case main body 32 is mounted to the cartridge mounting section.

The case main body 32 also has an air vent hole 325 next to the supply port 324, the air vent hole 325 being open in the bottom wall 32*a*. The air vent hole 325 is covered with a sealing film 39 welded with heat. The sealing film 39 is pealed off for use.

A front outer side wall (an outer side) 32*b*, one of a pair of outer sides of the case main body 32 perpendicular to the bottom wall 32*a*, is integrated with an engaging lever 326 that comes into engagement with the locking portion of the cartridge mounting section when the ink cartridge 21 is mounted to the cartridge mounting section of the inkjet printer. The front outer side wall 32*b* has part of a board mounting section 41 below the engaging lever 326, for mounting a circuit board 51.

As shown in FIGS. 2 and 4, the circuit board 51 has an readable and writable information storage element 53 on the back of a substantially rectangular board main body 52 and has connecting terminals 54 that comes into pressure contact with the connecting terminals of the cartridge mounting section of the inkjet printer to thereby electrically connect the information storage element 53 to the connecting terminals.

The board main body 52 of the circuit board 51 has a pair of mounting holes 52*a* and 52*b* that engage with a pair of board fixing bosses 42*a* and 42*b* of the board mounting section 41. The pair of mounting holes 52*a* and 52*b* is disposed at the upper rim and the lower rim of the board main body 52, respectively.

The board mounting section 41 is a recess for mounting the circuit board 51 having the information storage element 53. As shown in FIGS. 3 to 5, the board mounting section 41 includes the pair of board fixing bosses 42*a* and 42*b* that is fitted in the mounting holes 52*a* and 52*b* of the circuit board 51, for locating the circuit board 51; four guide walls 44*a*, 44*b*, 44*c*, and 44*d* erected along the peripheral four sides of the circuit board 51 located by the pair of board fixing bosses 42*a* and 42*b*; and a relief recess 47 for preventing interference with the information storage element 53 mounted to the circuit board 51. The circuit board 51 located by the board fixing bosses 42*a* and 42*b* is fixed to the board mounting section 41 by swaging the ends of the board fixing bosses 42*a* and 42*b* with heat.

In the case of the container main body 31 of this embodiment, the three guide walls 44*a*, 44*b*, and 44*c* of the four guide walls 44*a*, 44*b*, 44*c*, and 44*d* which constitute the board mounting section 41 form a substantially U-shape opening that is open to the cover 33 at the front outer side wall 32*b* of the case main body 32, and the guide wall 44*d* on the remaining side is provided at a rim of the cover 33.

Of the three guide walls 44*a*, 44*b*, and 44*c*, the guide wall 44*b* in the center facing the guide wall 44*d* on the cover 33 side has a pair of notches (also referred to as no-wall portions) 46*a* and 46*b* at both ends.

The pair of board fixing bosses 42*a* and 42*b* is disposed at the positions on the front outer side wall 32*b* of the case main body 32 facing the pair of notches 46*a* and 46*b*.

As shown in FIG. 4, the region of the board mounting section 41 enclosed by the three guide walls 44*a*, 44*b*, and 44*c* has the relief recess 47 for preventing interference with the information storage element 53 protruding from the back of the board main body 52 of the circuit board 51.

The cover 33 is a resin-ejection molding. The direction opposite to the case main body 32, indicated by arrow A in FIG. 1, is the direction in which the forming die is drawn (divided).

As shown in FIGS. 1 and 2, the cover 33 includes a rectangular flat plate 331 that covers the outer side of the resin film 35 that is thermally welded to one side of the case main body 32 and four outer side walls 332*a* to 332*d* erected from the outer periphery of the flat plate 331. The outer side walls 332*a* to 332*d* each have elastic engaging pieces 334 for joining the cover 33 to the case main body 32.

As shown in FIG. 3, the surface of the front outer side wall 332*b* of the cover 33 joined flush with the front outer side wall 32*b* of the case main body 32 has the guide wall 44*d* that forms the above-described board mounting section 41 in cooperation with the three guide walls 44*a*, 44*b*, and 44*c* of the case main body 32.

Referring now to FIGS. 6A and 6B and FIG. 7, a method for manufacturing the case main body 32 and the cover 33 of the ink cartridge 21 will be described.

FIG. 6A shows a first boss-forming section 61 and a second boss-forming section 62 joined by clamping a pair of forming dies; FIG. 6B shows the first boss-forming section 61 and the second boss-forming section 62 separated from each other by opening the pair of forming dies; and FIG. 7 is a cross-sectional view taken along line VII-VII of FIG. 6A. The forming dies illustrated are only the first boss-forming section 61 and the second boss-forming section 62.

The case main body 32 and the cover 33 of the ink cartridge 21 with the above structure are formed by injection molding using the pair of forming dies which is drawn in the direction of the combination of the case main body 32 and the cover 33 (along the arrow A of FIG. 1).

As shown in FIGS. 6A and 6B, the pair of board fixing bosses 42*a* and 42*b*, components of the board mounting section 41, are formed by the first boss-forming section 61 and the second boss-forming section 62. The first boss-forming section 61 is provided at one (a first die) of the pair of forming dies for forming the case main body 32 and forms the pair of notches 46*a* and 46*b* and the outer surfaces of the pair of board fixing bosses 42*a* and 42*b* adjacent to the notches 46*a* and 46*b*. The second boss-forming section 62 is provided at the other (a second die) of the pair of forming dies and forms the inner surface of the central guide wall 44*b* and the outer surfaces of the pair of board fixing bosses 42*a* and 42*b* adjacent to the substantially U-shaped opening.

The first boss-forming section 61 is integrated with the first die (e.g., the upper die) of the pair of forming dies for forming the case main body 32 and forms the semicircular outer surfaces of the pair of board fixing bosses 42*a* and 42*b* adjacent to the notches 46*a* and 46*b* by semicolumnar recesses 61*c* at the ends of a pair of projections which form the notches 46*a* and 46*b* on both sides of the central guide wall 44*b*.

The second boss-forming section 62 is integrated with the second die (e.g., the lower die) of the pair of forming dies for forming the case main body 32 and forms the outer surfaces of the pair of board fixing bosses 42*a* and 42*b* adjacent to the substantially U-shaped opening by semicolumnar recesses 62*c* at the ends of bumps 62*a* and 62*b* on both sides of a projection 62*d* that forms the inner surface of the central guide wall 44*d*.

According to the ink cartridge 21 and the method for manufacturing it described above, the board mounting section 41 for mounting the circuit board 51 to an outer side of the container main body 31 is not separate from the container main body 31, but the three guide walls 44*a*, 44*b*, and 44*c* and the pair of board fixing bosses 42*a* and 42*b* are integrated with the case main body 32, and the remaining guide wall 44*d* is integrated with the cover 33.

This eliminates the need for preparing a forming die exclusive to the board mounting section 41 in addition to one for forming the container main body 31, and also the need for combining the board mounting section 41 with the container main body 31.

In other words, the four guide walls 44*a*, 44*b*, 44*c*, and 44*d* that constitute the board mounting section 41 have a structure in which the three guide walls 44*a*, 44*b* and 44*c* form a substantially U-shaped opening that is open to the cover 33 at the front outer side wall 32*b* of the case main body 32, and the remaining guide wall 44*d* is disposed at a rim of the cover 33.

This prevents the guide walls 44*a*, 44*b*, and 44*c* that constitute the recessed board mounting section 41 from obstructing the removal of the forming dies when molding the case main body 32.

The board mounting section 41 can be formed with only a pair of forming dies and without using a sliding die that may cause complication of the forming dies. Moreover, the first boss-forming section 61 that forms the outer surfaces of the board fixing bosses 42*a* and 42*b* of the board mounting section 41 adjacent to the notches 46*a* and 46*b* can be drawn from the notches 46*a* and 46*b* in the direction in which the dies are drawn. Therefore, the board fixing bosses 42*a* and 42*b* can also be integrated with the case main body 32 without using a sliding die that may cause complication of the forming dies.

Furthermore, the board mounting section 41 of the ink cartridge 21 according to the embodiment has the relief recess 47 for preventing interference with the information storage element 53 mounted to the circuit board 51.

As shown in FIG. 7, the relief recess 47 is formed by a recess forming section 62*f* of the second boss-forming section 62 of the second die.

The container main body 31 having the relief recess 47 for preventing interference with the information storage element 53 mounted on the circuit board 51 can also be formed only with the pair of forming dies. This simplifies the structure of the forming dies and the number of assembly steps, thereby reducing the cost of manufacturing the ink cartridge 21 and increasing the productivity.

The liquid cartridge of the invention is not limited to the ink cartridge according to the embodiment. The liquid consuming apparatus to which the liquid cartridge of the invention is to be mounted is not limited to the inkjet printer according to the embodiment. These exemplary embodiments have been provided simply for the sake of teaching the broader invention by using a concrete example readily understood by the person familiar with this field.

Some examples of the liquid consuming apparatus include various apparatuses having a container mounting section to which the liquid cartridge is detachably mounted, to which the liquid held in the liquid cartridge is supplied; for example, an apparatus having a color-material injection head for use in manufacturing color filters of a liquid crystal display or the like, an apparatus having an electrode-material (conductive paste) injection head for use in forming electrodes of an organic EL display or a field emission display (FED), an apparatus having an organic-matter injection head for use in manufacturing biochips, and an apparatus having a sample injection head serving as a precise pipette.

What is claimed is:

1. A liquid cartridge comprising:

a container main body detachably mounted to a cartridge mounting section of a liquid consuming apparatus, the container main body including a case main body having a liquid reservoir and a cover that covers one side of the case main body; and a board mounting section provided on an outer side of the container main body, for mounting a circuit board having an information storage element, the board mounting section having a pair of board fixing bosses to be fitted in the mounting holes of the circuit board to locate the circuit board, and four guide walls provided on the peripheral four sides of the circuit board located by the pair of board fixing bosses;

wherein:

the three guide walls of the four guide walls constituting the board mounting section form a substantially U-shape opening that is open to the cover on the outer side of the case main body, and the other guide wall is provided at a rim of the cover;

the center wall of the three guide walls facing the guide wall on the cover side has a pair of notches at both ends; and the pair of board fixing bosses is disposed at the positions on the outer surface of the case main body facing the pair of notches.

2. The liquid cartridge according to claim 1, wherein the board mounting section has a relief recess for preventing contact with the information storage element mounted to the circuit board.

3. A method, for manufacturing a liquid cartridge, comprising:

forming a case main body and a cover with a only a pair of first and second forming dies drawn in the direction of a combination of the case main body and the cover, the combination of the case main body and the cover being a container main body for detachable mounting on a liquid consuming apparatus, the container main body having a liquid reservoir, the cover covering one side of the case main body;

wherein:

a board mounting section is provided on an outer side of the container main body, for mounting a circuit board having an information storage element;

the board mounting section has a pair of board fixing bosses for fitting in the mounting holes of the circuit board to locate the circuit board;

the board mounting section has four guide walls provided on the peripheral four sides of the circuit board located by the pair of board fixing bosses;

the pair of board fixing bosses includes a first boss-forming section and a second boss-forming section;

the first boss-forming section is provided at the first forming die for forming the case main body and forming the pair of notches and the outer surfaces of the pair of board fixing bosses adjacent to the notches; and the second boss-forming section is disposed at the second forming die and forms the inner surface of the center wall and the outer surfaces of the pair of board fixing bosses adjacent to the substantially U-shaped opening.

4. The method for manufacturing the liquid cartridge, according to claim 3, wherein:

the board mounting section is provided with a relief recess for preventing contact with the information storage element mounted to the circuit board; and the relief recess for is formed by a recess forming section of the second forming die.

* * * * *